US005353722A

United States Patent [19]

Vassiliou et al.

[11] Patent Number: 5,353,722

[45] Date of Patent: Oct. 11, 1994

[54] PREVENTIVE SLAG VISCOSITY CONTROL BY DETECTION OF ALKALI METALS IN THE OFF-GASES

[75] Inventors: Eustathios Vassiliou, Newark, Del.; David A. Kliauga, Egg Harbor City; Robin K. Baynes, Sewell, both of N.J.

[73] Assignee: Rollins Environmental Services, Inc., Wilmington, Del.

[21] Appl. No.: 106,536

[22] Filed: Aug. 16, 1993

[51] Int. Cl.[5] ..... F23G 5/00

[52] U.S. Cl. ..... 110/346; 110/185; 110/186; 110/246

[58] Field of Search ..... 110/246, 185, 186, 259, 110/346, 165

[56] References Cited

U.S. PATENT DOCUMENTS

| | | | |
|---|---|---|---|
| 3,693,557 | 9/1972 | Makuch | 110/1 J |
| 4,395,958 | 8/1983 | Caffyn et al. | 110/246 |
| 4,846,083 | 7/1989 | Serbent | 110/246 |
| 5,010,827 | 4/1991 | Kychakoff et al. | 110/185 |
| 5,080,026 | 1/1992 | Tsunemi et al. | 110/346 |
| 5,081,940 | 1/1992 | Motomura et al. | 110/346 |
| 5,158,024 | 10/1992 | Tanaka et al. | 110/186 |
| 5,228,398 | 7/1993 | Byerly et al. | 110/246 |

FOREIGN PATENT DOCUMENTS 60-259816 12/1985 Japan .

*Primary Examiner*—Henry C. Yuen

[57] ABSTRACT

Methods and devices for controlling the viscosity of the slag in incinerating kilns. The alkali content is measured in the stream of the off-gasses, and additives are added in order to counteract the effect of the alkalis on the slag viscosity. The rate of addition of additives depends on the alkali analysis and the off-gas temperature in the kiln.

30 Claims, 5 Drawing Sheets

PREVENTIVE SLAG VISCOSITY CONTROL BY DETECTION OF ALKALI METALS IN THE OFF-GASES

FIELD OF THE INVENTION

This invention relates to methods and devices for controlling incinerating kilns for waste materials. More particularly it pertains to methods and devices for controlling the viscosity of slag which is formed in rotary incinerating kilns.

BACKGROUND OF THE INVENTION

Incinerator kilns, and especially those of the rotary type, have an outside metallic shell, usually steel, the inside of which is fully covered by a thick ceramic or refractory, usually in the form of fire bricks having a total thickness exceeding in many cases 25 cm. These kilns usually operate at a exit gas or off-gas temperature in the range of about 1,600 to 2,400° F. The ceramic or refractory walls, however, are very vulnerable to erosion and corrosion, due to the hostile conditions created by the nature of incinerated materials and high temperatures, especially, if alkali metals are present. If the viscosity of slag in the kiln is adequately high, it may form a rather thick viscous coating on the refractory and thus protect it from the hostile environment. However, when the viscosity of the slag is very low, the slag contributes to the erosion and corrosion of the ceramic, both chemically because it serves as a solvent and mechanically, as it allows foreign big pieces of abrasive material to act against the ceramic walls. If the slag is viscous to the point of becoming substantially solid, or if it has never been formed as a liquid, it becomes ineffective in promoting combustion of organic matter, and also in capturing toxic heavy metals. Therefore, it is imperative that the viscosity of the slag is very carefully monitored and controlled within a range of values. Thus, one of the objects of this invention is to control the viscosity of the slag in incinerating kilns.

U.S. Pat. No. 5,301,621 (Vassiliou et al.), which is incorporated herein by reference, describes methods and devices for slag viscosity detection through image analysis of dripping slag within rotary incineration kilns.

U.S. Pat. 5,228,398 (Byerly et al.), which is also incorporated herein by reference, describes methods and devices for controlling rotary incineration kilns by determining the position of the kiln outlet at which the slag is exiting.

U.S. Pat. 5,158,024 (Tanaka et al.) discloses a combustion control apparatus for a powdered coal-fired furnace that monitors noxious substances contained within the burning waste gases, unburned substances with the ash and the power data of a pulverizing mill in order to operate the combustion furnace safely and efficiently. The combustion control apparatus infers from the current states or data optimal control amounts that will maintain within the minimum allowable ranges the noxious nitrogen oxides and the in-ash unburned substances that affect the combustion efficiency and thereby controls the combustion furnace with good stability. The combustion control apparatus qualitatively evaluates as fuzzy quantities the density data of the nitrogen oxides contained within the exhaust gases of the unburned substances contained within the ash, and the power data of the pulverizing mill. Based upon the evaluation results a fuzzy inference is formed so as to determine the optimum control amount of the two-stage combustion air ratio for minimizing the nitrogen oxides and also the optimum control amount for the fine/coarse gain separator so as to extract powdered coal of a grain size most effective for minimizing the unburned substances within the ash.

U.S. Pat. 5,010,827 (Kychakoff et al.) discloses an apparatus for detecting the presence of carryover particles in an upper region of a furnace, such as a smelt bed boiler, includes plural spaced apart detectors. These detectors monitor discrete portions of the interior of the furnace for the purpose of detecting carryover particles in such monitored portions. Signals indicative of the carryover particles are processed to obtain a count of the carryover particles. The carryover particle count may then be displayed. For example, the signals from all of the detectors may be averaged with trends and overall changes in count rates then displayed. In addition, the counts from the individual detectors may also be displayed to assist an operator in locating the source of excessive carryover particles in the furnace. An image sensor, such as a charged coupled device (CCD) detector, may be used to provide a visual display of detected carryover particles. The information on carryover particle count may be used in controlling parameters affecting the performance of the furnace directly, or indirectly by way of operator input.

U.S. Pat. No. 4,846,083 (Serbent, deceased) discloses a method for the production of a product which can be dumped or utilized, the mineral substances being subjected in a rotary kiln to a thermal treatment at a temperature at which the charge of the rotary kiln is transformed from a pasty to liquid slag phase. The composition of the charge is so selected that a slag phase is produced in which the main components, which constitute a matrix, are in the range from 60 to 72% $SiO_2$, 10 to 30% $Al_2O_3$ and 5 to 25% CaO+MgO, of said matrix, wherein the total percentage of $SiO_2$,+$Al_2O_3$+CaO+MgO equals 100, the total of the main components $SiO_2$, $Al_2O_3$, CaO and MgO amounts to more than 60% on a dry and ignition loss-free basis, of the mineral matter which is charged to the rotary kiln. The slag phase discharged from the rotary kiln is cooled and the exhaust gas from the rotary kiln is purified.

U.S. Pat. No. 4,395,958 (Caffyn et al.) discloses an incineration system for processing solid, semi-solid waste material and sludge includes an incinerator unit which has a horizontally disposed rotary primary oxidation chamber and a generally vertically disposed secondary oxidation chamber which receives gaseous products of combustion from the primary chamber. Baffles within the secondary chamber provide a tortuous gas flow path through the secondary chamber. Gaseous emissions from the incinerator unit pass through a heat recovery boiler, a baghouse and a scrubber tower before being discharged to atmosphere. A control system controls rotation of the primary oxidation chamber and an auger/shredder which feeds waste material to be burned into the primary oxidation chamber. The control system may include a programmable computer for modifying the control functions in response to programmed data relating to the characteristics of material processed in the incineration system.

U.S. Pat. No. 3,693,557 (Makuch) discloses a method and apparatus for controlling additive delivery to and circulation within an air pollution control system. The system of the invention controls the scrubber recycle flow rate and additive-to-fuel delivery ratio in response to an established pH operating level in the scrubber. The established pH operating level may be varied within limits in response to the sulfur oxide content of the gas leaving the scrubber for optimum additive usage.

Japanese Pat. 60-259816, issued Dec. 12, 1985, (Yamashita) has as purpose to automatically reduce the operation in response to the amount of emission by detecting the amount of pollutant emitted. It discloses a computing device, which, upon being inputted air pollution information from an input device, performs a predetermined computation to arrive at the operation reduction rate of respective pollutant releasing installations, in response to the inputted information. That is, by respective detectors, the amount of emission of pollutants in the exhaust gas that is released from the pollutant releasing installations is detected, and its result is inputted to the computation device via an information transmission device. Further, the computation result given by the computation device, via an information transmission device, which amounts to be the operation reduction rate for each pollutant releasing installation, is transmitted to and indicated by indicators a number of indicators.

None of the above references discloses, suggests, or implies the use of alkali analysis in the off-gases of incineration kilns for slag control, and especially for preventing the slag from assuming unacceptably low values.

SUMMARY OF THE INVENTION

As aforementioned, this invention relates to methods and devices for controlling the viscosity of slag in incinerating kilns for waste materials, by preventing it from assuming unacceptably low values. More particularly it pertains to an incinerating kiln device capable of controlling the viscosity of molten slag contained within the kiln, the device comprising a kiln adaptable to contain a quantity of molten slag, the molten slag being characterized by a viscosity, the kiln having an inlet end for feeding waste;

an outlet end opposite the inlet end for collecting solid products of incineration, means for introducing into the kiln an incinerating stream of gases, which incinerating gases, after coming into contact with the waste, produce a stream of off-gases;

alkali detection means within the stream of the off-gases for determining alkali content of the off-gases;

addition means for introducing additives into the kiln at a variable predetermined rate in order to influence the slag viscosity; and control means for processing data received from the alkali detection means and biasing the addition means in a manner to change the predetermined rate and force the slag viscosity toward a value within a desirable range.

Also, the present invention pertains to a method for controlling an incinerating kiln having an inlet end and an outlet end opposite the inlet end, the kiln being adaptable to contain a quantity of molten slag, the molten slag being characterized by a viscosity, the method comprising the steps of:

a) feeding waste to the kiln through the inlet end;

b) introducing into the kiln an incinerating stream of gases, which incinerating gases, after coming into contact with the waste, produce a stream of off-gases;

c) determining alkali content in the off-gases;

d) introducing additives into the kiln at a variable predetermined rate in order to influence the slag viscosity; and e) processing data received from step (c), so as to bias, if necessary, the introduction of additives of step (d) in a manner to change the predetermined rate and force the slag viscosity toward a desirable range.

The addition means may be operated manually, or at least partially automatically, and means for monitoring the temperature of the off-gases may be provided.

The control means may receive and process data from the temperature monitoring means, along with the data received from the alkali detection means, in order to bias the addition means in a manner to change the predetermined rate and force the slag viscosity to attain a value within the aforementioned desirable range.

The addition means may comprise bins for containing additives and for feeding additives to the kiln.

It is preferable that the off-gases flow in a direction from the inlet end toward the outlet end of the kiln, and that the alkali detection means are positioned at the outlet end of the kiln. The alkali detection means may comprise a water cooled suction probe for obtaining gas samples, and also an inductively coupled plasma spectrometer for analyzing the gas samples. The gas samples may be taken intermittently, or continuously.

In a different embodiment, the alkali detection means may comprise a wire passing through a cross-section of the stream of the off-gases for collecting matter, which matter is in sequence analyzed with respect to alkali metals. This matter collected on the wire may be analyzed by a method, such as for example flame spectroscopy or inductively coupled plasma spectroscopy.

BRIEF DESCRIPTION OF THE DRAWING

The reader's understanding of practical implementation of preferred embodiments of this invention will be enhanced by reference to the following description taken in conjunction with the drawing figures, wherein.

DETAILED DESCRIPTION OF THE INVENTION

As previously mentioned, this invention relates to methods and devices for controlling rotary incinerating kilns for waste materials. More particularly, it pertains to methods and devices for controlling the viscosity of slag contained in a rotary incinerating kiln by detecting the alkali content in the stream of off-gasses during the incineration process, and controlling the addition of appropriate additives in the kiln in order to maintain the viscosity of the kiln within an acceptable range, and preventing it from assuming unacceptably low values. This invention also pertains to combinations of other important parameters which are vital for the efficient operation of incineration kilns, as discussed in detail hereinwith.

Figure 1:
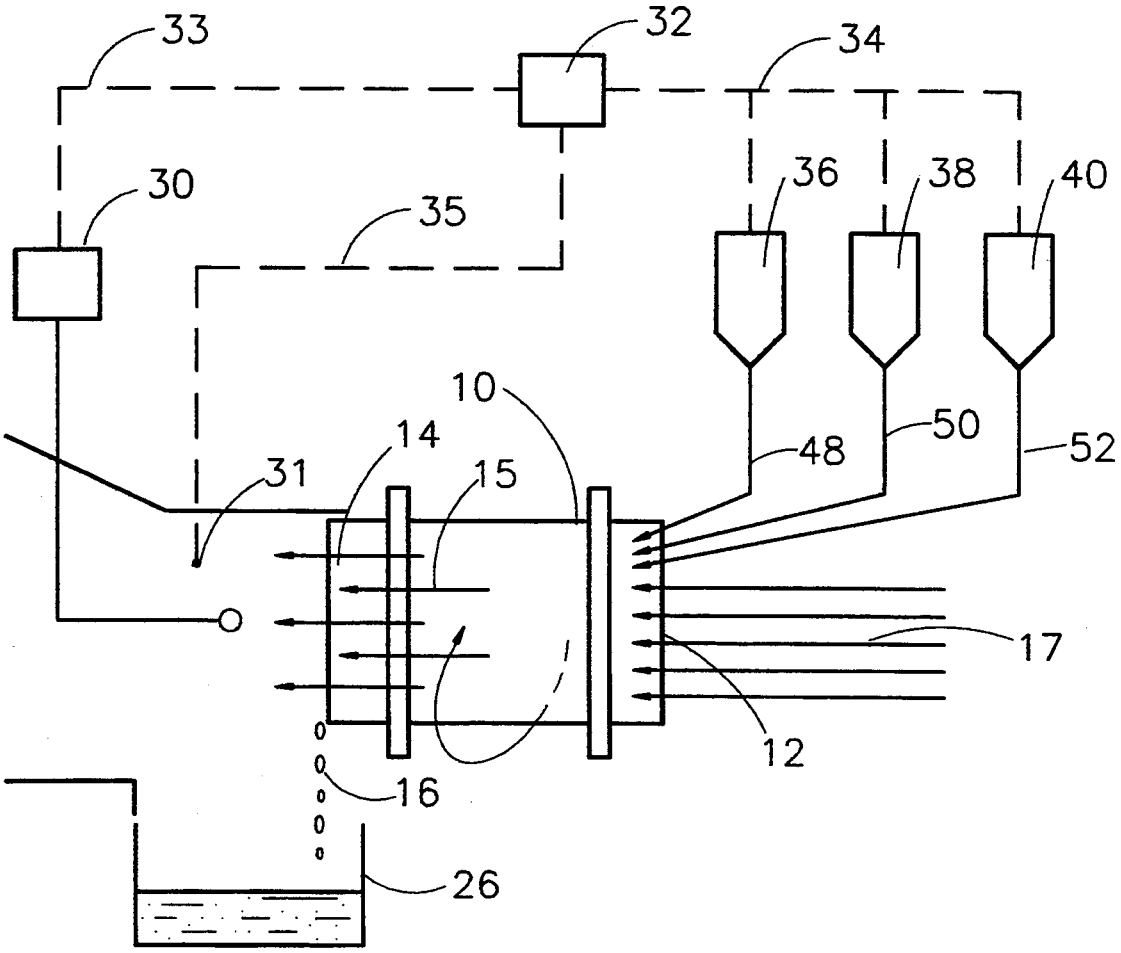
FIG. 1 shows schematically a kiln device provided with waste feed lines, fuel lines, and additive lines, according to one embodiment of the present invention.

Referring now to FIG. 1 there is schematically depicted a rotary incineration kiln 10, well known to the art, according to a preferred embodiment of this invention. The kiln 10 has an inlet end 12 for waste material feeding, and an outlet end 14 opposite the inlet end 12, which in this particular case is an exit for a stream of off-gases denoted by arrows 15 and for slag 16. In other occasions, the gases may have the opposite direction than the one shown in FIG. 1.

The slag 16 is produced by the waste, as well as by different additives fed usually through the inlet end of the kiln. The slag may be newly formed in its totality, or it may be recirculated, depending on the desired performance of the kiln. Liquid or gaseous waste materials may be fed through lances (not shown) or other mechanisms, well known to the art of kilns. For purposes of clarity, fuel burners and other conventional devices needed for the operation of the kiln are not shown in detail, since they are well known to the art of incinerating kilns. The arrows 17 represent miscellaneous such feeding lines for solid waste, liquid waste, fuel, air, oxygen, and the like, well known to the art. Gases such as oxygen, air, and the like, which promote incineration, are termed as incineration gases. Bins 36, 38, and 40 may feed additives trough lines 48, 50, and 52, respectively. Of course, more or less bins may be present, or the additives may be introduced into the kiln manually through appropriate ports (not shown), well known to the art. The additives are useful in controlling the viscosity of the slag 16, and to improve the binding of any heavy metals into the slag. The additive in bin 36 may be a viscosity builder, such as silica or alumina for example, while the additive in bin 38 may be a viscosity reducer, such as "window" glass for example. Bin 40, as well as other bins (not shown) may contain other additives, such as slag for recirculation, for example. In case the kiln is too dry (the slag level in the kiln is too low), either recirculated slag may be introduced, or a combination of glass with sand and/or alumina (usually in the form of an ore) may be added.

Depending on the additive contained in the rest of the bins, such as bin 40, for example, the additive, powdered or crushed slag for recirculation for example, may be added in a similar manner. If the powdered or crushed recirculating slag has very high viscosity when being in the molten state at temperatures, preferably in the range of 1,800° to 2,200° F., it may be used as a viscosity builder or thickener, when added in the kiln. On the other hand, if the recirculating slag has very low viscosity when being in the molten state, in the range of the preferred aforementioned temperatures, it may be used as a viscosity reducer. Thus, depending on the degree of deviation from an acceptable range, a stronger or weaker viscosity modifier (thickener or reducer) or a combination thereof may be introduced to the kiln. The above process is continued to ensure that the viscosity of the slag does not fall outside the predetermined range of desired values, and that an adequate amount of slag is present in the kiln. A good method of controlling the slag viscosity is described in U.S. Pat. No. 5,301,621 (Vassiliou et al.), as aforementioned. However, according to that method, time delays have to be built in the system, especially if the system is computerized, so that no overshooting occurs, and therefore feeding of sand (source of silica raising the viscosity) and glass (reducing the viscosity), for example, is only used to correct viscosity deviations of the slag caused by the waste fed and not by the one or the other or both. This is because there is a definite time lag between the detection and determination of the slag viscosity, and the corrective measures, according to that method. In contrast, the present invention provides a method which prevents the slag viscosity from drastically changing to attain low values, which are catastrophic to the refractory of the kiln. While with other methods, the low viscosity has to occur first, then detected, and then corrected, the method of the present invention prevents the viscosity from assuming very low values, or at least counteracts such a tendency of the slag.

The slag in incineration kilns is mainly composed of different inorganic oxides. Since the temperatures occurring in such kilns are usually in the neighborhood of 2,000 oF or even higher, the oxides employed have to be capable of forming long molecular networks, so that the viscosity of the slag remains relatively high. When alkali metal oxides are present in the composition of the slag they break the long molecular networks into smaller entities, which has as result lowering of the viscosity. To counteract this lowering of viscosity, network forming oxides (silica in the form of sand) are introduced to the kiln as additives. In waste management, analysis is done in samples of the feed well in advance before entering the incinerator. However, in many occasions, especially when drums containing solids are fed, sampling cannot accurately represent the total contents of a drum, and thus a larger quantity of alkalis may be actually fed than the analysis has shown. According to the present invention, the real alkali content will be detected during the incineration of the drum in the kiln, and immediate increase in the feeding rate of sand, for example, will take place to prevent unacceptable lowering of the viscosity.

The rotary kiln 10 of this particular embodiment shown in FIG. 1, has a substantially cylindrical shape, as aforementioned. The kiln is preferably inclined 1–8%, more preferably 2–6%, and even more preferably 3–4%. During normal operation, the kiln also rotates, preferably at 0.05 to 0.5 rpm, and more preferably at 0.1 to 0.25 rpm, when the diameter of the kiln is 3–5 meters. However, it is also preferred that the kiln has the capability to turn, if desirable for certain functions, at higher speeds in the region of 0.5 to 4 RPM. The higher speeds may be utilized, for example, to remove quickly unwanted local accumulations of slag from the kiln. The combination of the inclination and the rotation forces the slag 16 to exit from the outlet 14 during the operation of the kiln.

It is preferable that slag 16 falls into a tank of water or deslagger 26. The deslagger 26 may have a submerged apron conveyor or a drag flight conveyor (not shown), both very well known in the art, at its bottom end 28 for removing the slag. The deslagger 26 serves the purpose of cooling the slag fast and breaking it into smaller and more manageable pieces. In addition, the quenching of the slag in water helps the slag to trap more tightly different heavy metals, which might be present.

The kiln 10, also has an inside wall 18, better shown in FIGS. 5*a* to 5*d*, a bottom side 20, and a ceiling side 22, both of which are part of the inside wall 18. The inside wall 18 of the rotary kiln 10 is usually made of refractory brick, having a thickness of preferably 20–35 cm, built on top of a steel skin, having a thickness of preferably 2–5 cm, for kilns having a diameter of about 3–4 m and a length of about 10–13 m.

The rotary kiln 10 is adaptable to contain a quantity of molten slag 16, in a manner that when the kiln rotates, at least a portion of the molten slag 16 temporarily adheres to the inside wall 18 and it is transferred from the bottom side 20 of the kiln 10 to the vicinity of the ceiling side 22, from where it may fall back to the bottom side 20, at least partially, in the form of drippings 24. In addition, due to the inclination combined with the rotation of the kiln 10, slag 16 falls into the deslagger 26 from the outlet end 14, as better shown in FIG. 1. From the deslagger, the quenched slag may be appropriately packaged and stored for landfilling, or it may be recirculated through bin 40, for example.

Although direct and instantaneous measurement of the slag viscosity has not been achieved so far, indirect measurement, as described in detail in our aforementioned co-pending application, gives excellent results. Thus, the characteristics of the drippings 24, serve an important role in estimating the viscosity and quantity of the slag being present in the kiln. The most important characteristics or properties for this purpose are:

- the size of the drippings, represented by the arithmetic average of the cross-sectional area of said drippings, and calculated as the total area of all drippings divided by the number of the drippings;
- the shape of the drippings, represented by the arithmetic average of the shape factors of the drippings, well known to the art of Image Analysis;
- the aspect ratio of the drippings, represented by the arithmetic average of the aspect ratios of said drippings, the aspect ratio defined as the length of an object (dripping in this case) divided by the width of the object; and
- the number of the drippings, represented by the absolute number of drippings within a predetermined period of time.

Figure 5A:
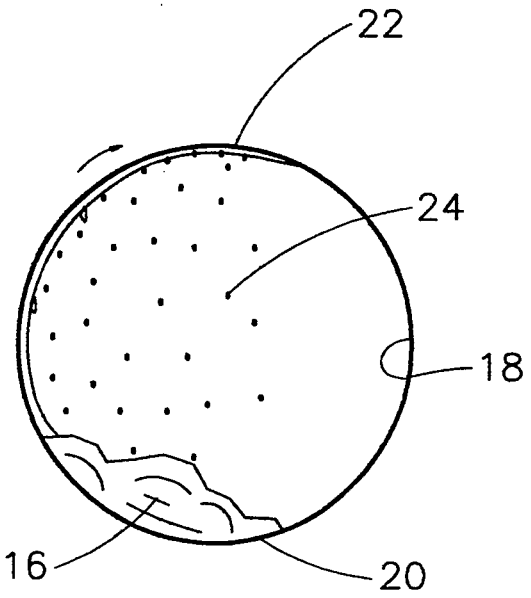
FIGS. 5*a* to 5*d* schematically represent different conditions of slag viscosity as manifested by the form of drippings of slag within a rotating kiln.
Figure 5B:
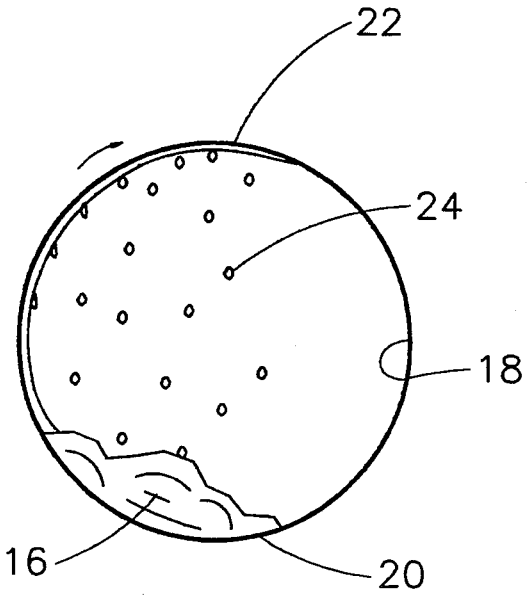

FIGS. 5*a* to 5*d* show different slag viscosity conditions. The slag viscosity according to the "drippings" method may be assessed either by means of an image analyzer, or by an operator comparing visually the images shown in FIGS. 5*a* to 5*b* with the actual slag condition in the kiln. The condition shown in FIG. 5*a* represents slag of very low and unacceptable viscosity. The viscosity in FIG. 5*b* is better, but still unacceptable. The viscosity of the slag in FIGS. 5*c* and 5*d*, as well as the inbetween conditions represent an acceptable range of slag viscosities.

Thus, when the viscosity of the slag is excessively low, threatening the longevity of the kiln refractory, it has the appearance of rain, as it falls from the ceiling 22 of the kiln, and as better shown in FIG. 5*a*. The drippings are many, rather rounded, and small. As the viscosity increases, the number of drippings decreases, the drippings become more oblong, which raises the aspect ratio, and larger, which raises the average cross-sectional area of the drippings, as better illustrated in the sequence of FIGS. 5*b*, 5*c*, and 5*d*. A highly desirable viscosity of the slag is represented by the condition shown in FIG. 5*d*, and the goal in most occasions is for the kiln to operate under parameters providing such a condition. However, this is not practical many times, and broader viscosity limits are usually necessary for optimal overall operation of the kiln. Thus, a slag viscosity ranging from the vicinity of the condition represented by FIG. 5*c* to the vicinity of the condition represented by FIG. 5*d* is acceptable in most occasions.

Figure 2:
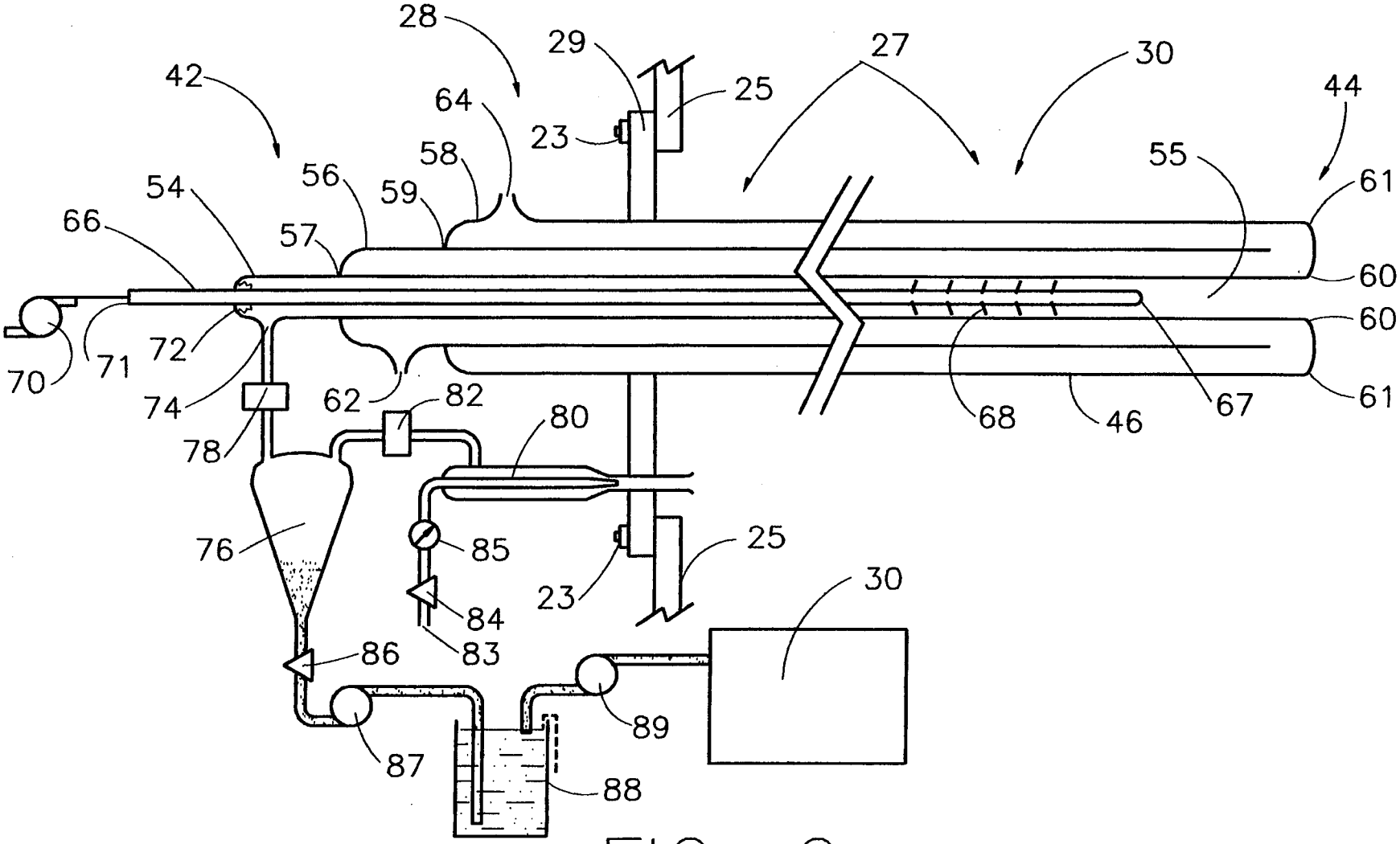
FIG. 2 illustrates schematically a water-cooled suction probe for obtaining off-gas samples for analysis relative to alkali content.

Referring back to FIG. 1, there are provided alkali detection means comprising in this case a water cooled suction probe 30, better shown in FIG. 2, and an inductively coupled plasma spectrometer 30'. The suction probe 30 is positioned within the stream of the off-gases represented by arrows 15, preferably in the vicinity of the outlet end 14 of the kiln 10. The probe 30 is preferably constructed from a heat durable material, such as stainless steel or other alloy, which can withstand the adverse, corrosive and high temperature conditions of the kiln environment. Ceramic materials and combination of metallic with ceramic materials may also be used in the construction of the probe.

There is also preferably provided a thermometer 31, which may be of the thermocouple type, or any other suitable type in order to read the temperature of the off-gases of the kiln 10. The temperature data from this thermometer are directed to the computer 32 through a second input line 35. The computer means 32 communicates with additive feeding bins 36, 38, and 40 though output line 34 in a manner to individually increase or decrease the feed of each one to kiln 10. It also communicates with one or more of the feeding lines represented by the arrows 17 through additional outputs (not shown in FIG. 1 for purposes of clarity) in order to appropriately regulate their feed rates, if necessary.

Referring to FIG. 2, there is depicted in more detail, the suction probe 30, used for sampling the off-gases 15, in order to determine the content in alkalis.

In this particular embodiment, the detection and determination of alkalis is directed mostly to those alkali entities in the off-gases, which are water soluble. In fact, the soluble alkalis are by far the most important in the practice of the present invention, because they represent species which are most prone to reduce the viscosity of the slag. Water soluble alkalis have usually as source simple compounds, such as for example salts, oxides, hydroxides, and the like. These, when introduced to the long molecular network of the slag, break said network to smaller molecular species, thus reducing the slag viscosity drastically. Alkalis which are not water soluble, are usually themselves part of a long molecular network, such as for example glasses, and the like, and thus, when introduced to the slag they have a considerably reduced effect in lowering the slag viscosity. Therefore, the detection of the water soluble alkalis is of higher importance and value.

Referring back to FIG. 2, the probe 30 comprises a flange 29, located close to the outer end 42 of the probe 30, and away from the inner end 44. The flange 29 is preferably rigidly connected, by welding for example, to the outer jacket 46. The flange 29, in turn, is supported with nut/bolt arrangements 23 onto a wall 25, which is a side wall between the outlet end 19 of the kiln 10 and an afterburner (not shown), well known to the art. This side wall 25 separates the off gas region 27 from the atmosphere 28. Of course, there is a thick insulating refractory liner (not shown for purposes of clarity) on the side of the hot off-gas region 27 in order to protect the wall 25 .

The probe 30, which may have a thermal and/or anti-corrosion refractory insulation over the outer jacket 46, further comprises a suction tube 54, which defines a suction region 55. The suction tube 54 is surrounded by a first cooling tube 56, which in turn is surrounded by a second cooling tube 58. Tubes 54, 56, and 58 are sealed on top of the other at positions 57 and 79 in the vicinity of the outer end 42 of the probe 30. In the vicinity of the inner end 44 of the probe 30, the cooling tube 56 is open ended, while the inner end 60 of the suction tube 54 is connected to and closed under the inner end 61 of the cooling tube 58. The cooling tube 56 has a water inlet 62 for introducing cooling water, while cooling tube 58 has a water outlet for removing cooling water.

Inside the suction tube 54, there is provided a sprinkler tube 66, which is closed at the inner end 67, and has a plurality of small holes 68 for spraying water in the suction area 55 of the suction tube 54. A first pump 70, capable of pumping water is connected to the outer end 71 of the sprinkler tube 66. The sprinkler tube 66 is preferably connected to the outer end 72 of the suction tube 54 in a manner to be easily removable, such as for example by threaded parts, and the like. This is preferably arranged in this manner, so that from time to time, after the sprinkler tube is removed from the suction tube 54, the suction tube may be cleaned by a plunger (not shown) throughout its length, and especially at its inner end 60 which is more prone to clogging with time from particles entrained in the off-gases. At this point, it is worth noting that the probe 30 is preferably slightly inclined (preferably 5–20 degrees) in a way that the inner end 44 is at a higher level than the outer end 42, so that condensation products in the suction region 55, as well as water from the spraying holes 68 run toward the outer end 72 of the suction tube 54, as sample for analysis.

The suction tube 54 also has a sample opening 74, pointing downwardly, which communicates with a sample separator 76 through a first filter 78. In turn, the sample separator communicates with an eductor 80 through a second filter 82. The eductor 82 creates vacuum, preferably by using compressed air entering air-inlet 83, and passing through on-off valve 84 and pressure regulator 85. Other gases, such as for example steam, and the like, may be used in place of the preferable compressed air. The sample separator 76 has a second on-off valve 86 at its lower end, which is in turn connected to a second pump 87 used to transfer the sample to the bottom of sample vessel 88. A third pump 89 transfers portion of the sample to an analytical instrument 30', which is preferably an inductively coupled plasma spectrometer.

In operation of this embodiment, the kiln 10, schematically illustrated in FIG. 1, is fed through some of lines 17 with waste liquids, and fuel if necessary, to maintain a temperature of off-gases in the range of 1,600 and 2,400 oF, and preferably in the range of 1,800 and 2,200 oF. At the same time, solid waste is fed either continuously with a screw conveyor, for example, or in batches of one drum at a time through one of lines 17. Preferably, the drums are fiber-drums, but many times, steel drums are also being used. The different forms of waste are been sampled beforehand, and depending on the results of the sample analysis relative to content in alkalis, a certain feed schedule for the additives is established and followed. However, for a large number of reasons, the alkali amount being fed into the kiln per unit time may change drastically. The sampling for example of solid waste, especially the that which is fed in drums, is by necessity far from perfect. Thus, it is possible that the sample analysis may show a low content in alkali, while the bulk of the solid waste may contain a considerably higher amount of alkali.

Due to the large velocity of air, which is used for incineration, a high turbulence is taking place throughout the kiln. Thus, when the solid waste is fed and burst into flames, a considerable amount of solid particulate matter is entrained into the turbulent air stream along with vapors, and while being incinerated, it is carried by the off-gases 15 throughout the rest of the length of the kiln, mostly ending in the afterburner, and finally, the rest of it is filtered or scrubbed in order to be removed from the gasses which are released to the atmosphere. The entrained particular matter and vapors contain for all practical purposes the same constituents as the waste fed to the kiln, and if the concentration of one constituent increases substantially in the feed, the concentration of this one constituent will respond accordingly in the off-gases. For the purposes of the instant inventions small changes in concentration of constituents, such as alkalis, is of no great importance.

The probe 30, as better illustrated in FIG. 2, is positioned within the stream of gases 15, and takes samples of these gases by sucking and treating a small portion of them as explained in detail hereinbelow.

While the probe is in place, so that a large portion of it is in the off-gas region 27, cooling water is introduced through the water inlet 62, and it exits from water outlet 64 of tube 58. The cooling water is necessary to keep the probe cool and protect it from the hot off-gases the temperature of which is in the vicinity of 2,000 oF. The cooling water travels initially through the length of the first cooling tube 56, over the suction tube 54, and toward the inner end 44 of the probe 30, at which point it reverses direction, because of the open-ended structure of tube 56, and it follows the path toward the outer end 42 of the probe 30, exiting finally from the outlet 64. It is preferable that the outlet 64 points up, so that if for any reason steam is formed, the steam will escape easily without forcing first a large mass of water to exit. This arrangement also allows any non-condensible gases which are initially dissolved in the cooling water to escape. It is also preferable to have pressure sensors (not shown), such as for example low pressure indicators and alarms, for detecting large deviations of water pressure from a normal predetermined range within the cooling zone of the probe, so that when such a large deviation occurs, the cooling water supply is cut-off, and a siren notifies the operator to take action, such as removing the probe from the kiln, for example.

As aforementioned, the operation of the probe regarding sampling, may be continuous or intermittent. In a version of a continuous mode, air is passed through the air-inlet 83, the first on-off valve 84, which is normally open, and finally through eductor 80, thus ending in the off-gas region 27. The air passing through the eductor, produces vacuum or reduced pressure. This reduced pressure extends through the sample separator 76 to the suction region 55, and causes off-gases to enter the suction region and move through sprayed pure, preferably deionized, water from the small holes 68 of the sprinkler tube 66. Of course, instead of the small holes, one may use a spray nozzle at the inner end 67 of the tube 66. The amount of water sprayed through the small holes 68 of tube 66 is regulated by the pump 70.

The sprayed water, along with condensation water from the inside walls of the suction tube 54, moves toward the sample opening 74 due to the aforementioned inclination of the probe 30. Cooled off-gases, which are washed with the sprayed water, also move in the same direction, and along with the water, they pass through the sample opening 74, the filter 78, which removes water-insoluble particulates, and they end up in the sample separator 76, wherein the washed and filtered off-gases are separated from the liquid water, which water contains dissolved therein water-soluble materials, previously contained in the off-gases. The water soluble materials according to this invention are, as aforementioned, alkalis. The washed and filtered off-gases pass in turn through a second filter 82 to ensure that the eductor will not be plugged by any particles which accidently overpassed the first filter 78. Finally, they move from the eductor to the off-gas region 27.

The liquids are falling by gravity to the bottom of the separator 76, from where they pass through the second on-off valve 86, which is normally open, and then they are pumped by the second pump 87 into the open sample vessel 88. It is important that the pump 87 produces somewhat lower pressure behind it than the eductor produces, in order to ensure movement of the liquids from the separator 76 to the bottom of the sample vessel 88. In turn, the third pump 89 moves a liquid at a low rate, preferably from the top of the sample vessel 88 to the analytical instrument 30', which is preferably an emission spectrometer, such as for example, a flame spectrometer or an inductively coupled plasma spectrometer. The inductively coupled spectrometer is more preferred than the flame spectrometer.

Preferably, the amount of water pumped by the first pump 70, which water goes to the separator 76, is coordinated with the amount of water removed by pump 87 from the separator 76, so that they are about equal to each other. This may be done in a number of ways. One simple way is to set the first pump 70 to deliver a desirable amount of water per unit of time, then set the regulator 85 to a desired compressed air-pressure which will produce a desirable degree of vacuum, and finally set the second pump 87 in a manner to pump out of the separator an amount of liquid approximately equal to the amount entering the separator. Other arrangements may also be made, such as for example to provide the separator with a level switch (not shown), which switch interacts with the second pump 87, in a manner to maintain a desirable constant level (preferably low) of liquid in the separator 76.

The sample vessel 88 overflows continuously, since the amount of liquid needed for analysis is considerably smaller than the amount entering the sample vessel 88. The overflown liquid as well as any gases that may enter the vessel 88 may be discarded by incineration, or any other methods of safe decontamination.

The analysis with the preferred instruments, such as for example emission spectrometers, is for all practical purposes instantaneous. In this respect, the content of the liquid in alkalis, such as for example Na, K, and Li, may be determined substantially continuously and instantaneously. The results of this analysis is transmitted to the computer 32 by means of line 33', better shown in FIG. 1. The temperature of the off-gases 15 is also transmitted to the computer 32 from the thermometer 31 by means of line 35. The temperature is important in that at higher temperatures the viscosity of the slag is lower, and therefore higher amounts of viscosity builders, such as sand or alumina for example, are needed. Other information, such as the compressed air-pressure used, the rate of the sprayed water in the suction region, The liquid removal rate from separator 76, and any other pertinent information is also fed to the computer 32 through respective lines (not shown for purposes of clarity). The data received from the different sources of information, are then processed by the computer by very well known to the art techniques. Of course, all pertinent constants of the apparatus, such as for example dimensions, diameters, lengths, and the like are registered in the computer memory for performing well known calculations during the data processing.

As aforementioned, additives from bins 36, 38, and 40 may be arranged to being fed continuously at a predetermined rate depending on an analysis of the waste made in advance by sampling portion of the waste. Alternatively, they may be arranged to being fed only on a "per need" basis. In either case, but considerably more so in the later case, an unnoticed and/or unexpected alkali-rich waste introduction may be detrimental for the refractory wall of the kiln due to lowering of the slag viscosity and to the high reactivity of the alkali group.

Figure 5C:
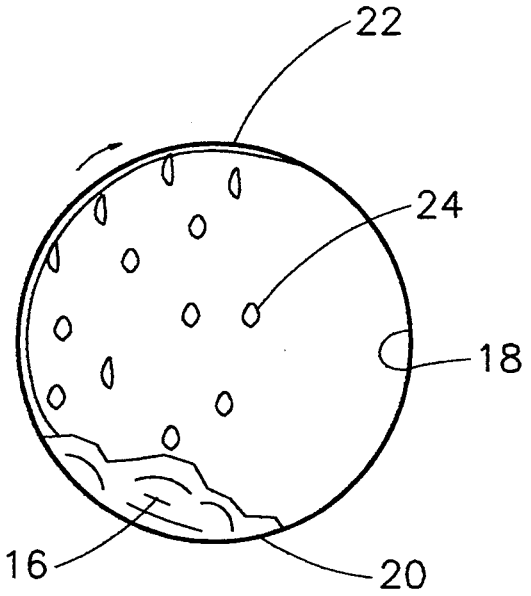
Figure 5D:
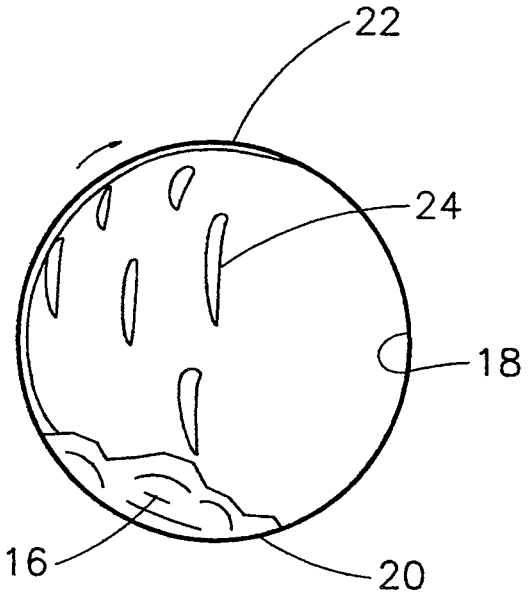

Depending on the alkali content introduced into the kiln, based on the analysis in analytical instrument 30', the computer causes bin 36, containing for example a viscosity builder, such as for example silica, alumina, and the like, to deliver an appropriate amount of viscosity builder, in order to counteract the effects due to the alkalis, and maintain the viscosity at or toward a desired range, such as for example the one defined by FIGS. 5*c* and 5*d*. The computer 32 may also trigger an alarm when unexpectedly high amounts of alkalis are detected, for the operator to watch and correct, if necessary, the situation. In the case that bins are not available or the bins cannot be controlled directly by the computer, an operator may take instructions from the computer and introduce the appropriate amounts of additive(s) semi-automatically by operating the bins, or even manually.

Calibration of the apparatus may be made by feeding the kiln with controlled amounts of alkalis and correlating them with the analytical results.

When sand is used for counteracting the ill effects of alkalis, preferably more than 5 times as much sand as alkalis has to be added, and more preferably more than 10 times as much.

The computer 30' is also used for controlling other bins, such for example bins 38 and 40, containing other corrective additives, for use in occasions where more slag is needed, or the slag has become too dry, and the like, or for a programmed feeding.

As aforementioned, the probe 30 may also be sampling intermittently. According to this embodiment, the first on-off valve 84 stays on for a period of time, for example 10 seconds, and stays off for another period of time, for example 50 seconds. This cycle is repeated indefinitely. While the first valve 84, which causes vacuum to be produced by the eductor and suction of gases, is on, the first pump 70 is also on providing spray water in the suction region 55, the second valve 86, as well as the second and third pumps, 87 and 89 are off. In this manner, liquid is accumulated at the bottom of the separator 76. In sequence, the first on-off valve and the first pump turn off, while the second valve 86, and pumps 87 and 89 turn on, so that the liquid which was collected at the bottom of the separator 76, is now pumped into the sample vessel 88, and a composite sample is transferred to the analytical instrument for analysis. In many occasions, it is preferable that the volume of liquid collected in the separator 76, equals the volume of vessel 88. The rest of the operation is similar to that of the previously discussed embodiment of continuous sampling.

Intermittent sampling is most useful in occasions where the probe and kiln conditions are such that plugging of the probe takes place too often.

In either case of intermittent or continuous operations, if so desired, the first filter 78 may be removed, so that the particulate matter remains suspended, and analysis of the total (water-soluble and water-insoluble) alkalis may be performed. Alternatively, a large porosity filter may be provided to remove just the unacceptably large particles, which might interfere with the analytical instrument 30, or other parts of the apparatus. Also, acid digestion of the particulate matter may be conducted, by introducing the appropriate acid, such as nitric acid, hydrochloric acid, sulfuric acid, chromic acid, and combinations thereof, for example, preferably in the separator 76.

Figure 3:
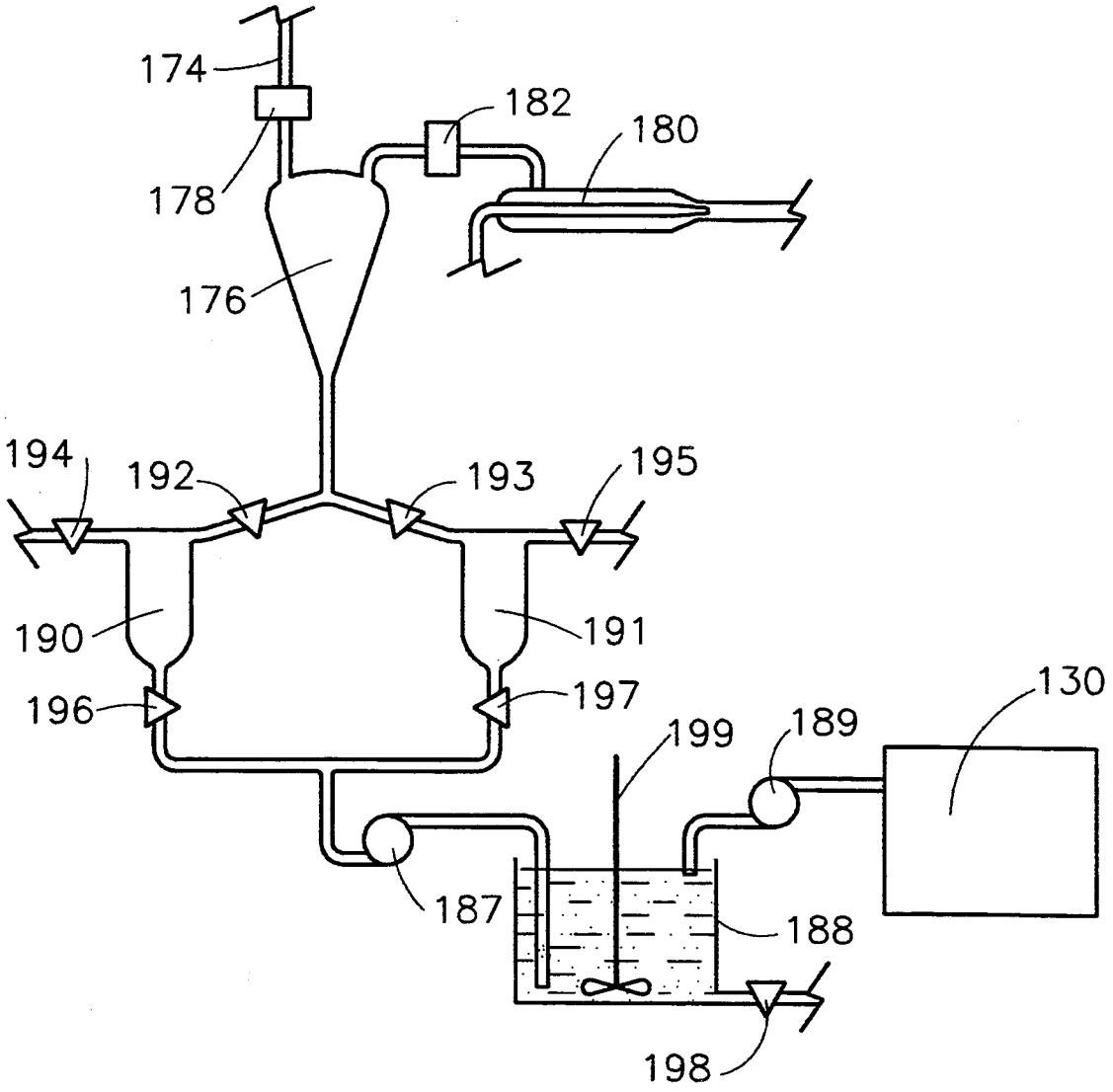
FIG. 3 illustrates schematically a sampling arrangement attached to the water-cooled suction probe according to another embodiment of the present invention.

In a different embodiment of this invention, the part of the apparatus starting at the separator and ending at the analytical instrument, is replaced by the assembly schematically illustrated in FIG. 3. In this embodiment, the separator 176 is connected symmetrically to first sample collector 90 and a second sample collector 191, connected to the separator 176 through on-off valves 192 and 193, respectively. The collectors further comprise, preferably at their top, venting on-off valves 194 and 195 respectively, and dispensing on-off valves 196 and 197, respectively. The latter two valves are leading to a second pump 187, which may pump any liquid received, to a sample vessel 188, which vessel comprises a final on-off valve 198 and a stirrer 199. A third pump 189 is used to transfer sample at slow rate from the sample vessel 188 to the analytical instrument 130'.

In the operation of this embodiment, wash water continuously flows into the separator 176 through sample opening 174 and first filter 178, due to the fact that eductor is continuously in operation and produces vacuum, while the first pump 70, better shown in FIG. 1, continuously pumps water through holes 68 in the suction region 55, in order to wash, in the form of a mini-scrubber, the incoming off-gases.

In a first phase of this operation, valve 192 is open, allowing the wash water from the separator to flow in the collector 190, while valves 193, 194, 195, 196, 197, and 198, as well as the second pump 187 and the third pump 189 are in the off-position. After a predetermined period of time, valve 192 closes, and valves 193, 194 and 196 open, and pump 187 is turned on and transfers very fast the liquid contained in sample collector 190 to the sample vessel 188, where it is stirred by stirrer 199. The pump 187 and the valves 194 and 196 are then turned off. After optional addition of any digestive materials, and/or other additives, and adequate stirring, in the sample vessel, a sample is taken by pump 189 to the analytical instrument 130' for alkali analysis. Pump 189 is then turned off, and the valve 198 opens for disposing of the analyzed liquid, and then it is turned off again.

In sequence, valve 193 closes, and valves 195 and 197 open. The liquid collected in sample collector 191 is pumped by pump 187 to the sample vessel 188, and the procedure is followed as before, in a manner that when liquid is been collected in one collector, liquid leaves the other collector, and analyzed. Collection times of 1 to 5 minutes are preferable, since the analysis will represent the mean value of alkali content for the whole period of 1 to 5 minutes. This timing is not excessive for good control of the viscosity building additive proper addition. The rest of the operation is similar to the operation of the previous embodiments.

Figure 4:
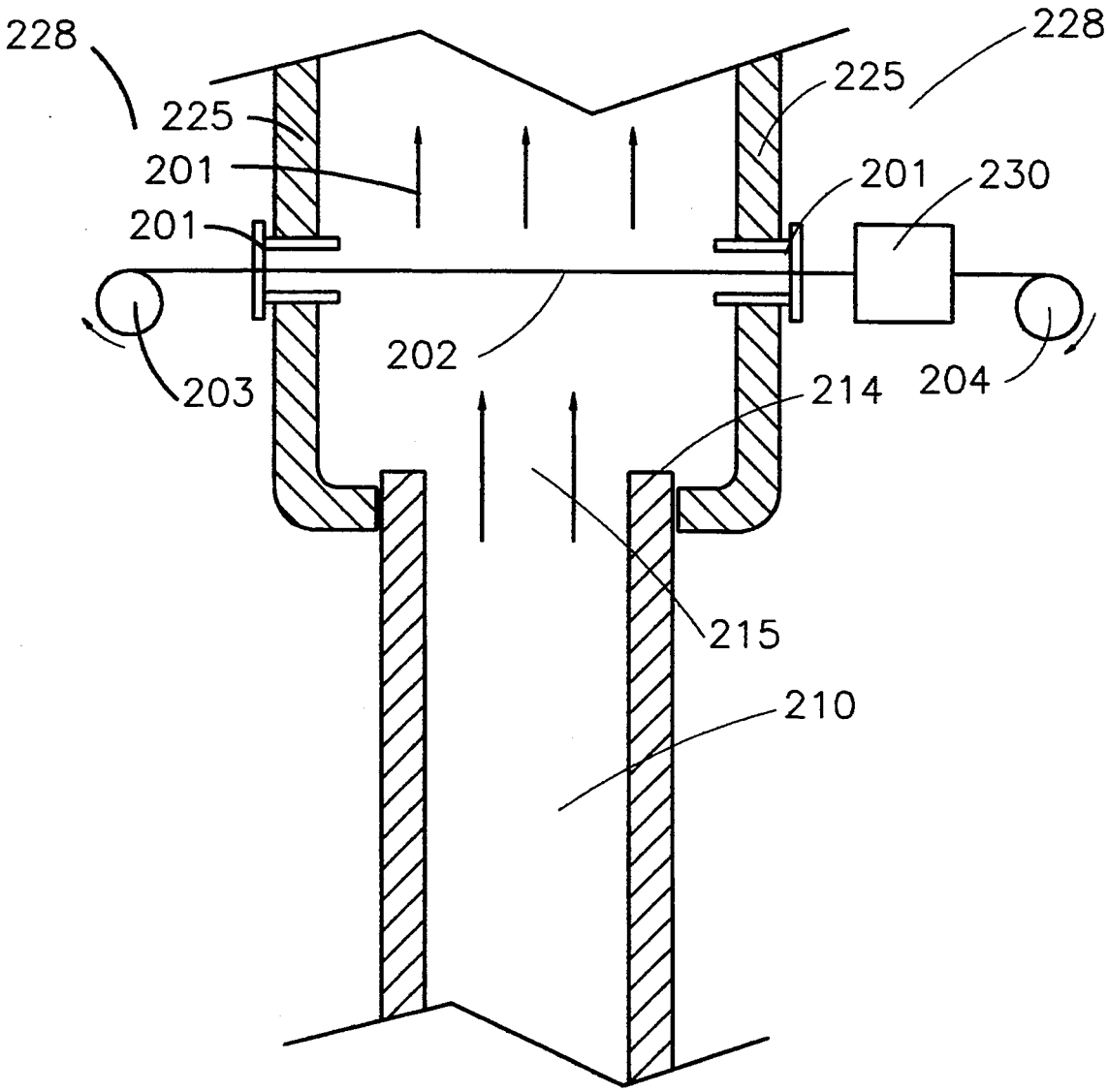
FIG. 4 represents a cross-sectional top view of a kiln device, which uses a winding wire passing through the off-gas stream in order to collect matter for alkali analysis.

In still a different embodiment, the suction probe has been replaced by a wire passing through a cross-section of the stream of the off-gases 15 for collecting matter, which matter is in sequence analyzed with respect to alkali metals. This embodiment is better illustrated in FIG. 4. In this case, the alkali detection means comprise a stretched wire 202 being transferred from a first spool 203 to a second spool 204 through a first opening 201 and a second opening 201' on the separation walls 225 in the front of the outlet end 214 of the kiln 210, and in the path of the stream of off-gases 215, and off-gas region 227. The wire 202, before it is wound in spool 204, it passes through analytical instrument 230', which is preferably a flame spectrometer or a inductively coupled plasma spectrometer.

The wire is preferably made of a high temperature resistant material, such as for example tungsten, and the like. It may also be made of ceramic fiber, and the like.

As with the previous embodiments, this device may be used to detect not only alkalis but any other metals as well.

In operation, the wire is being unwound from spool 203, and is being wound on spool 204, being well stretched at all times by well known to the art techniques. As the wire is passing through the stream 215 of the off-gases, some of the entrained matter, still in molten state, or even as powder, is attached on the wire. As the wire passes through the analytical instrument 230', its content in alkalis is determined and the data are fed to a computer (not shown), where they are processed and used to control the slag viscosity in a manner similar to that utilized in the other embodiments described above.

The different embodiments and examples, described above in detail, have been given for demonstration purposes only, and they should not be construed as limiting the claimed matter and scope of the present invention.

Numerals differing by 100 in the Figures represent similar elements intended to perform similar functions.

What is claimed is:

1. An incinerating device comprising a kiln adaptable to contain a quantity of molten slag, the molten slag being characterized by a viscosity, the kiln having an inlet end for feeding waste;

an outlet end opposite the inlet end for collecting solid products of incineration, means for introducing into the kiln an incinerating stream of gases, which incinerating gases, after coming into contact with the waste, produce a stream of off-gases;

alkali detection means within the stream of the off-gases for determining alkali content of the off-gases;

addition means for introducing additives into the kiln at a variable predetermined rate in order to influence the slag viscosity; and control means for processing data received from the alkali detection means and biasing the addition means in a manner to change the predetermined rate and force the slag viscosity toward a desirable range.

2. A device as defined in claim 1, wherein the addition means are operated manually.

3. A device as defined in claim 1, wherein the addition means are operated at least partially automatically.

4. A device as defined in claim 1, further comprising means for monitoring the temperature of the off-gases.

5. A device as defined in claim 4, wherein the control means also receive and process data from the temperature monitoring means, along with the data received from the alkali detection means, in order to bias the addition means in a manner to change the predetermined rate and force the slag viscosity toward said desirable range.

6. A device as defined in claim 5, wherein the addition means are operated manually.

7. A device as defined in claim 5, wherein the addition means are operated at least partially automatically.

8. A device as defined in claim 5, wherein the addition means comprise bins for containing additives and for feeding additives to the kiln.

9. A device as defined in claim 1, wherein the off-gases flow in a direction from the inlet end toward the outlet end of the kiln.

10. A device as defined in claim 9, wherein the alkali detection means are positioned at the outlet end of the kiln.

11. A device as defined in claim 9, wherein the alkali detection means comprise a water cooled suction probe for obtaining gas samples.

12. A device as defined in claim 11, wherein the alkali detection means further comprise an inductively coupled plasma spectrometer for analyzing the gas samples.

13. A device as defined in claim 11, wherein the gas samples are taken intermittently.

14. A device as defined in claim 11, wherein the gas samples are taken continuously.

15. A device as defined in claim 1, wherein the alkali detection means comprise a wire passing through a cross-section of the stream of the off-gases for collecting matter, which matter is in sequence analyzed with respect to alkali metals.

16. A device as defined in claim 15, wherein the matter is analyzed by a method selected from a group consisting of flame spectroscopy and inductively coupled plasma spectroscopy.

17. A method for controlling an incinerating kiln having an inlet end and an outlet end opposite the inlet end, the kiln being adaptable to contain a quantity of molten slag, the molten slag being characterized by a viscosity, the method comprising the steps of:

a) feeding waste to the kiln through the inlet end;

b) introducing into the kiln an incinerating stream of gases, which incinerating gases, after coming into contact with the waste, produce a stream of off-gases;

c) determining alkali content in the off-gases;

d) introducing additives into the kiln at a variable predetermined rate in order to influence the slag viscosity; and e) processing data received from step (c), so as to bias, if necessary, the introduction of additives of step (d) in a manner to change the predetermined rate and force the slag viscosity toward a desirable range.

18. A method as defined in claim 17, wherein the step of introducing additives in the kiln is performed manually.

19. A method as defined in claim 17, wherein the step of introducing additives in the kiln is performed at least partially automatically.

20. A method as defined in claim 17, further comprising a step of monitoring the temperature of the off-gases.

21. A method as defined in claim 20, wherein data received from monitoring the temperature are also processed and combined with the data received from the alkali determination step, so as to bias, if necessary, the introduction of additives of step (d) in a manner to change the predetermined rate and force the slag viscosity toward a desirable range.

22. A method as defined in claim 20, wherein the step of introducing additives in the kiln is performed manually.

23. A method as defined in claim 20, wherein the step of introducing additives in the kiln is performed at least partially automatically.

24. A method as defined in claim 20, wherein the step of introducing additives in the kiln is conducted from bins containing said additives.

25. A method as defined in claim 17, wherein the off-gases flow in a direction from the inlet end toward the outlet end of the kiln.

26. A method as defined in claim 25, wherein the step of determining the alkali content is conducted at the outlet end of the kiln.

27. A method as defined in claim 25, further comprising a step of obtaining gas samples by means of a water cooled suction probe, for determining the alkali content 28. A method as defined in claim 27, wherein the determination of the alkali content of the gas samples is conducted by means of an inductively coupled plasma spectrometer.

29. A method as defined in claim 27, wherein the gas samples are taken intermittently.

30. A method as defined in claim 25, wherein the gas samples are taken continuously.

* * * * *